United States Patent [19]

Saito et al.

[11] Patent Number: 4,930,839

[45] Date of Patent: Jun. 5, 1990

[54] SINGLE-LEGGED CHAIR

[75] Inventors: Osamu Saito; Kazuko Iwano; Yasushi Ikeda, all of Tokyo, Japan

[73] Assignee: Soft Energy Co., Ltd., Japan

[21] Appl. No.: 222,800

[22] Filed: Jul. 22, 1988

[51] Int. Cl.[5] ..... A47C 1/02

[52] U.S. Cl. ..... 297/338; 297/4; 248/155.3

[58] Field of Search ..... 297/4, 5, 338, 195; 248/157, 155, 155.2, 155.3, 155.4

[56] References Cited

U.S. PATENT DOCUMENTS

| | | | |
|---|---|---|---|
| 636,074 | 10/1899 | Skoog | 248/155.3 |
| 1,972,668 | 9/1934 | Sheldon | 248/155.2 |
| 3,322,460 | 5/1967 | Leverman | 297/338 X |
| 4,098,478 | 7/1978 | Spitzke | 297/4 |
| 4,138,156 | 2/1979 | Bonner | 297/4 |
| 4,232,896 | 11/1980 | Caldwell | 297/4 |
| 4,653,808 | 3/1987 | Opsvik | 297/4 X |
| 4,676,547 | 6/1987 | Spillman | 297/4 |
| 4,684,090 | 8/1987 | Sharkland | 248/155 |

*Primary Examiner*—Laurie K. Cranmer

*Attorney, Agent, or Firm*—Bruce L. Adams; Van C. Wilks

[57] ABSTRACT

A single-legged chair comprising a support post and a seat mounted on the support post at a predetermined position thereof so as to constitute a leg portion by a lower part of the support post below the seat, the general plane of the seat lying at an angle of 70° to 85° with respect to the support post at least when the chair is in use. In use, the seat lies virtually horizontally as the leg portion stands on the ground or floor in an inclined posture.

5 Claims, 13 Drawing Sheets

SINGLE-LEGGED CHAIR

BACKGROUND OF THE INVENTION

1. Field of the Invention:

The present invention relates to a chair, and more particularly to a single-legged chair.

2. Description of the Prior Art:

FIGS. 10(*a*), 10(*b*) and 10(*c*) of the accompanying drawings illustrate a typical conventional single-legged chair now on the market. The chair includes a single support post 200 constituting a leg portion, and a seat 210 pivotally mounted on the upper end of the support post 200 by means of a bracket 220 and a pin 222. The seat 210 has a relatively large opening 240 and hence a grip portion 210*a*; if the seat 210 is folded over the support post 200 as shown in FIGS. 10(*c*) and 10(*d*), the chair can be used as a stick. Designated by 230 is an anti-skid cap of rubber mounted on the lower end of the support post 200.

However, with this conventional arrangement, since the seat would assume a forwardly inclined posture while the user is sitting, the seated person ought to feel not so comfortable and hence would easily get tired. And this conventional single-legged chair is large in moment of angular movement and thus non-stable in use so that the seated person would easily get tired.

Another problem with the conventional chair is that since the entire structure of the chair is disposed under the buttocks of the seated person, it is difficult for the seated person to grip any part of the chair when changing the standing posture of the chair or otherwise moving the chair.

Further, since the support post and thus the leg portion cannot be adjusted in length, the conventional chair is not suitable for various users whose legs are different in length.

SUMMARY OF THE INVENTION

It is therefore an object of the present invention to provide a single-legged chair which guarantees an improved degree of stability in use so that the user can sit on it for a relatively long time without getting tired.

Another object of the invention is to provide a single-legged chair which is easy to change its standing posture and to move its standing position or place while the user is sitting.

A further object of the invention is to provide a single-legged chair having a leg portion which can be adjusted in length commensurate with the length of the user's legs.

According to the present invention, a single-legged chair comprises a single support post, and a seat mounted on the support post at a predetermined position thereof so as to constitute a leg portion by a lower part of the support post below the seat. The general plane of the seat lies at an angle of 70° to 85° with respect to the support post at least when the chair is in use so that the seat can lie virtually horizontally as the leg portion stands on the ground or floor in an inclined posture.

Many other objects, features and additional advantages of the present invention will become manifest to those versed in the art upon making reference to the following detailed description and the accompanying sheets of drawings in which a certain structural embodiments incorporating the principles of the present invention are shown by way of illustrative example.

BRIEF DESCRIPTION OF THE DRAWINGS

FIG. 3(*b*) is a cross-sectional view taken along line B—B of FIG. 3(*a*);

FIG. 4(*b*) is a bottom view of a saddle to be used in combination with the saddle-support member of FIG. 4(*a*);

FIG. 5(*b*) shows the chair of FIG. 5(*a*) in folded form;

FIGS. 8(*b*) and 8(*c*) are graphs showing a comparative force distribution of the present and prior art chairs;

FIG. 10(*b*) is an enlarged side elevational view of the chair of FIG. 10(*a*);

FIG. 10(*c*) is a view similar to FIG. 10(*b*), but showing the seat in folded posture; and FIG. 10(*d*) is a rear elevational view of FIG. 10(*c*).

DETAILED DESCRIPTION

Figure 1:
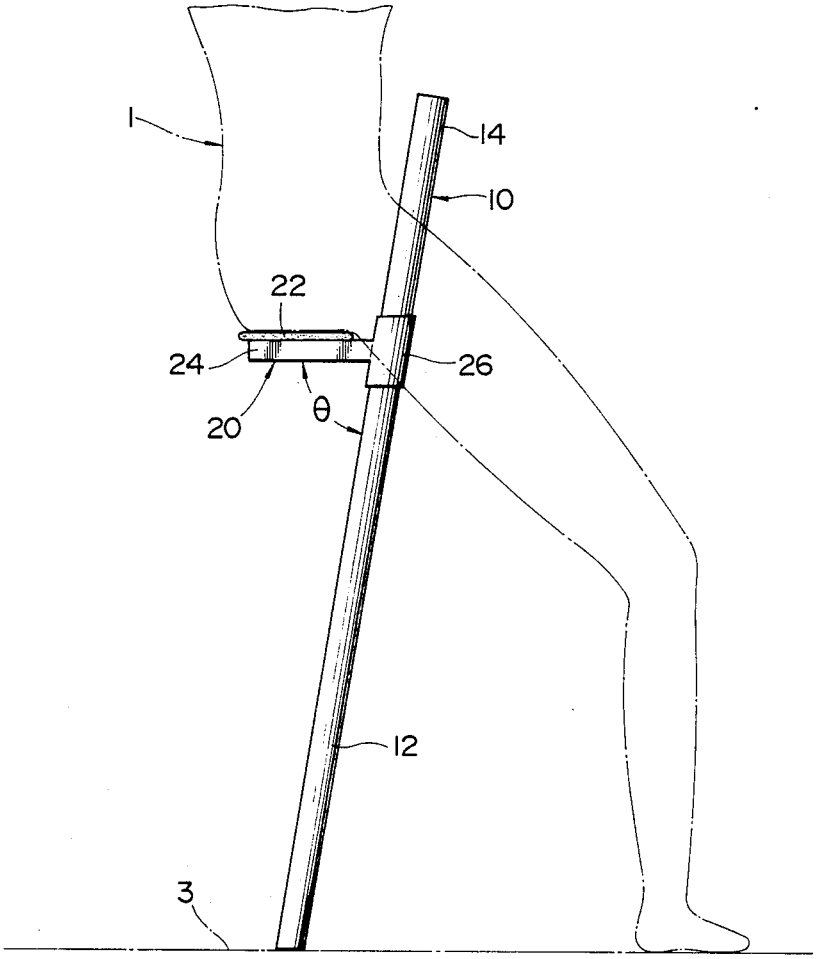
FIG. 1 is a side elevational view of a single-legged chair embodying the present invention.
Figure 2A:
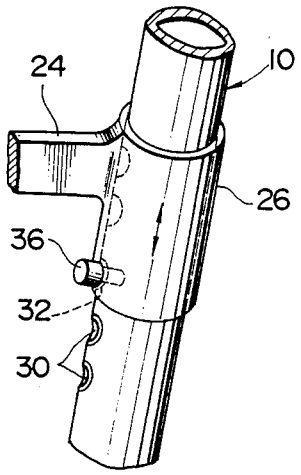
FIGS. 2(*a*), 2(*b*), 2(*c*), 2(*d*), 2(*e*) and 2(*f*) are enlarged fragmentary perspective views of the chair, showing various forms of a leg-length adjusting means.
Figure 2B:
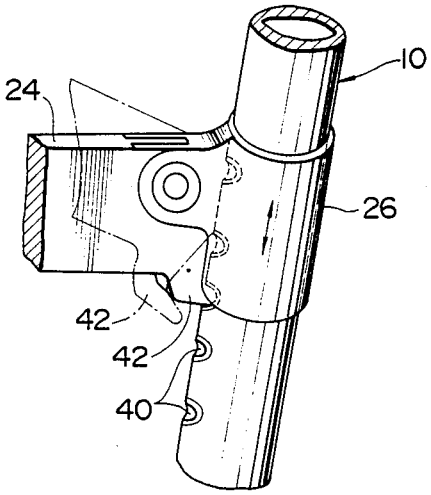
Figure 2C:
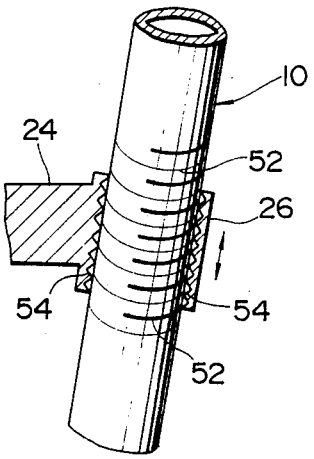
Figure 2D:
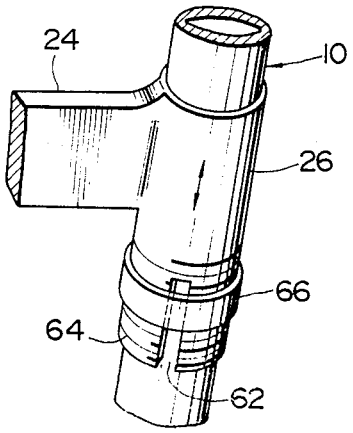
Figure 2E:
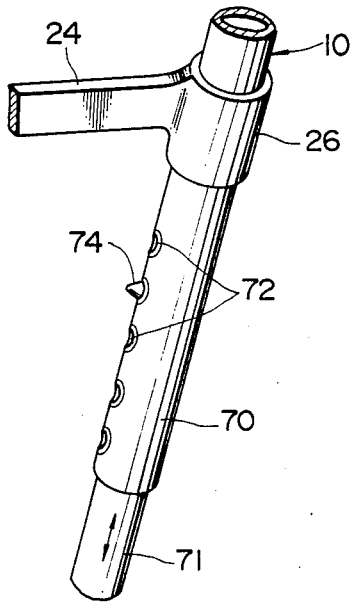
Figure 2F:
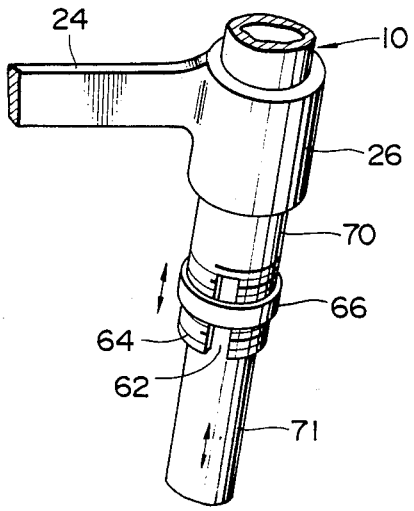

The principles of the present invention are particularly useful when embodied in a single-legged chair (hereinafter called "chair") such as shown in FIG. 1.

The chair generally comprises a support post 10, and a seat 20 mounted on the support post 10 at a predetermined position thereof so as to constitute a leg portion 12 by a lower part of the support post 10 below the seat 20 and a grip portion 14 by an upper part of the support post 10 above the seat 20.

The seat 20 includes a saddle 22 for receiving the buttocks of a seated person 1, and a saddle-support member 24 on which the saddle 22 is supported.

The support post 10 may be a solid rod or a tube, having a substantially circular cross section. Alternatively, the support post 10 may have a rectangular or other polygonal cross section; however, to minimize the entire weight of the chair for easy carrying, the support post 10 should be preferably in the form of a tube.

The saddle-support member 24 has at one end a tubular mounting portion 26 through which the support post 10 is inserted.

Most important, the seat 20 lies at an angle $\theta$ of 70° to 85° with respect to the support post 10. In use, the user 1 sits on the seat 20 astride of the support post 10 and adjusts the angle of inclination of the support post 10 with respect to the ground surface 3 in such a manner that the seat 20 assumes a virtually horizontal or slightly forwardly inclined posture. At that time the seated person unintendedly adjusts the width of his stance and also the distance between his feet and the lower end of the support post 20 to attain a more comfortable and agreeable sitting posture. Experiments conducted under the direction by the inventors show that pleasant sitting and a high degree of stability can be obtained when the angle between the support post 20 and the ground or floor surface 3 is within the range of 70° to 85°.

Another factor to guarantee pleasant sitting with a high degree of stability is the height of the seat 20 above the ground surface 3 and thus the length of the leg portion 12. If the length of leg portion 12 were fixed, the chair would be suitable for a variety of users who are different in height. To this end, the present chair is provided with a means for adjusting the length of the leg portion 12 commensurate with the height of the individual user, as described below in conjunction with FIGS. 2(*a*) through 2(*f*). According to the experiments conducted by the inventors, it is preferable that generally the length of the leg portion 12 is 25% to 44% of the user's height.

FIGS. 9(*a*) through 9(*f*) illustrate various uses of the chair. The user may sit on the seat astride of the support post in such a posture that the grip or upper portion of the support post is disposed in front of the seated person, as shown in FIGS. 9(*a*) and 9(*b*). For a change, the user may sit astride on the seat with his back waist resting against the grip portion, as shown in FIGS. 9(*c*) and 9(*d*). Further, the user may sit on the seat with the grip portion disposed at the side of the seated person, as shown in FIGS. 9(*e*) and 9(*f*). The uses of FIGS. 9(*c*) to 9(*f*) are particularly suitable for a lady user wearing a skirt. In either backward or sideward sitting, the absolutely same degree of stability as in the normal or forward sitting can be achieved.

FIGS. 2(*a*) through 2(*f*) illustrate various examples of the leg-length adjusting means. In the example of FIG. 2(*a*), the support post 10 has a plurality of openings 30 spaced at a predetermined distance along the support post 10, and the mounting portion 26 of the saddle-support member 24 has a single hole 32; in use, the hole 32 is brought into alignment with one of the openings 30, and then a pin 36 is inserted through the hole 32 into the one opening 30. By choosing one of the openings 30 into which the pin 36 is to be inserted, it is possible to retain the seat 20 on the support post 10 at a desired position and thus it is possible to adjust the leg portion 12 to a desired length.

In the example of FIG. 2(*b*), the support post 10 has a plurality of recesses 40 spaced at a predetermined distance along the support post 10, and the saddle-support member 24 is pivotally connected to the mounting portion 26 and has on its lower side a pawl 42 engageable with one of the recesses 40. If the saddle-support member 24 is pivotally moved so as to bring the pawl 42 out of engagement with the one recess 40, the mounting portion 26 can be moved along the support post 10 to adjust the length of the leg portion 12.

According to the example of FIG. 2(*c*), the support post 10 has an external screw portion 52, and the tubular mounting portion 26 has an inner screw portion 54 and thus is threadedly mounted on support post 10; to move the seat 20 along the support post 10, the saddle-support member 24 is simply revolved about the support post 10. With this arrangement, it is possible to vary the length of the leg portion 12 on a step-less or continuous basis which enables a fine adjustment.

According to the example of FIG. 2(*d*), the tubular mounting portion 26 of the saddle-support member 24 has an external screw portion 64 and a pair of longitudinal cutouts 62, 62 disposed in the external screw portion 64 in a diametrically opposed relation. A retainer ring 66 is threadedly mounted on the external screw portion 64 so as to cross the two cutouts 62, 62. Each of the cutouts 62 has in free form a width reducing progressively toward its upper end so that as the retainer ring 66 is rotated so as to move downwardly along the mounting portion 26, the inside diameter of the mounting portion 26 is reduced, thus securing the mounting portion 26 to the support post 10. As the retainer ring 66 is rotated reversely to move upwardly along the mounting portion 26, the inside diameter of the mounting portion 26 is allowed to become large so that the mounting portion 26 can be moved along the support post 10. Thus the length of the leg portion 12 can be adjusted on a continuous or stepless basis.

Unlike the previous examples of FIGS. 2(*a*) to 2(*d*) in which the relative length of the leg portion 12 can be adjusted by moving the seat 20 along the support post 10, in the examples of FIGS. 2(*e*) and 2(*f*), the relative length of the leg portion 12 can be changed without moving the seat 20 along the support post 10. According to the example of FIG. 2(*e*), the support post 10 is composed of a tubular outer member 70 and an inner member 71 telescopically inserted in the tubular outer member 70. The tubular outer member 70 has a plurality of holes 72 spaced at a predetermined distance along the outer member 70, and a pin 74 is carried by the inner member 71 and is normally spring-biased to project through one of the holes 72 to thereby prevent the outer and inner members 70, 71 from moving relative to each other. When the pin 74 is depressed so as to retract from the one hole 72 against the bias of a non-illustrated spring, the inner member 71 is allowed to slide longitudinally along the outer member 70. The inner member 71 may be be either solid or hollow, but preferably in the form of a tube.

Also in the example of FIG. 2(*f*), the support post 10 is composed of telescopically outer and inner members 70, 71. The outer member 71 has an external screw portion 64 and a pair of diametrically opposed longitudinal cutouts 62, 62 in the screw portion 64. A retainer ring 66 is threadedly mounted on the outer member 70 at the external screw portion 64 so as to extend across the two cutouts 62, 62. The mode of operation of this adjusting means is similar to the example of FIG. 2(*d*), and therefore its description is omitted here for clarity.

Figure 3A:
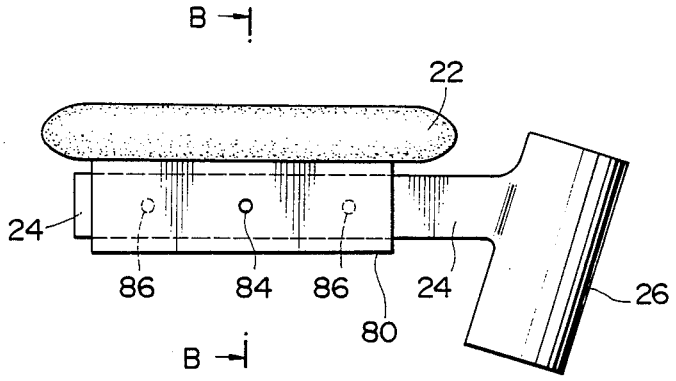
FIG. 3(*a*) is an enlarged side elevational view of a seat of the chair.
Figure 3B:
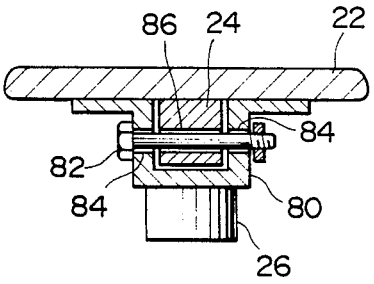

The saddle 22 may be fixed to the saddle-support member 24, or may be movably connected to the saddle-support member 24, as shown in FIGS. 3(*a*) and 3(*b*), in which the saddle 22 is fixed to a bracket 80 of U-shaped cross section defining an elongated channel receptive of the saddle-support member 24. The bracket 80 has in its opposite sidewalls a pair of transversely aligned openings 84, 84, and the saddle-support member 24 has a plurality of transverse holes 86; to secure the saddle 22 to the saddle-support member 24, a headed screw bolt 82 is inserted through the pair of openings 84, 84 and one of the transverse holes 86, extending threadedly through a nut. If the screw bolt 82 is removed, the saddle 22 is allowed to move along the saddle-support member 24 toward and away from the support post 10. If the saddle 22 is removed, the chair can be used as a stick.

Figure 4A:
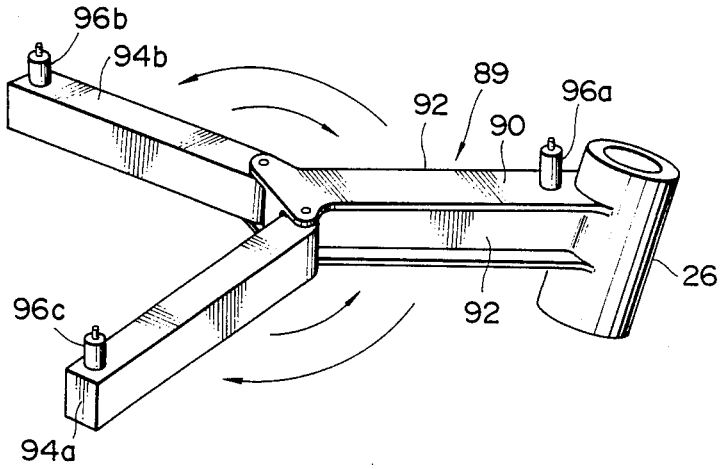
FIG. 4(*a*) is a perspective view of a modified saddle-support member of the seat.
Figure 4B:
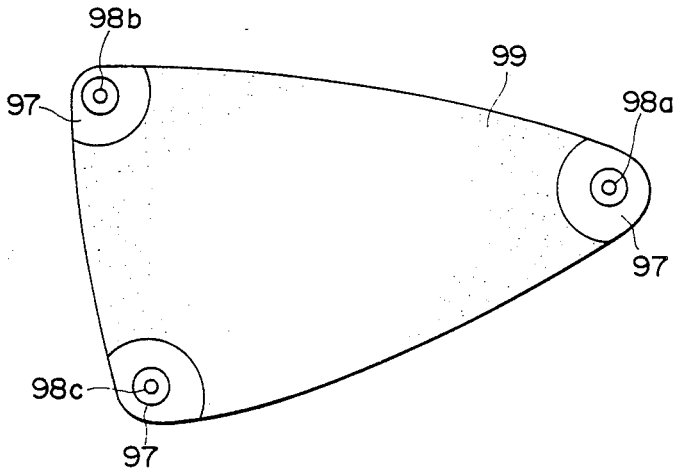

FIG. 4(*a*) illustrates a modified form of the saddle-support member 24. The modified saddle-support member 24 includes an arm 90 projecting from the tubular mounting portion 26, and a pair of auxiliary arms 94*a*, 94*b* pivotally mounted on a free end of the arm 90. The arm 90 has a generally I-shaped cross section defining a pair of side recesses 92, 92 one on each side of the arm 90 for receiving the respective auxiliary arms 94*a*, 94*b* as the latter are folded. If the auxiliary arms 94*a*, 94*b* are folded, the chair can used as a stick. A first support pin 96*a* is carried by the arm 90 near the mounting portion 26, and second and third support pins 96*b*, 96*c* are carried by the respective auxiliary arms 94*b*, 94*a*.

FIG. 4(*b*) shows the bottom of a modified saddle 99 to be used in combination with the modified saddle-support member 89. The modified saddle 99 has in its bottom first, second and third stepped holes 98*a*, 98*b*, 98*c* for receiving the first, second and third support pins 96*a*, 96*c*, 96*b*, respectively, of the saddle-support member 89 as the auxiliary arms 94*a*, 94*b* are expanded. Preferably, three reinforcing strips 97, 97, 97 are applied to the bottom of the saddle 99 at portions around the holes 98*a*, 98*b*, 98*c*.

The saddle 22 may be made of natural or synthetic leather, synthetic resin or metal. If the saddle 22 is synthetic resin or metal, it may be covered with leather or cloth, or may be provided with a cushion of urethane.

Figure 5A:
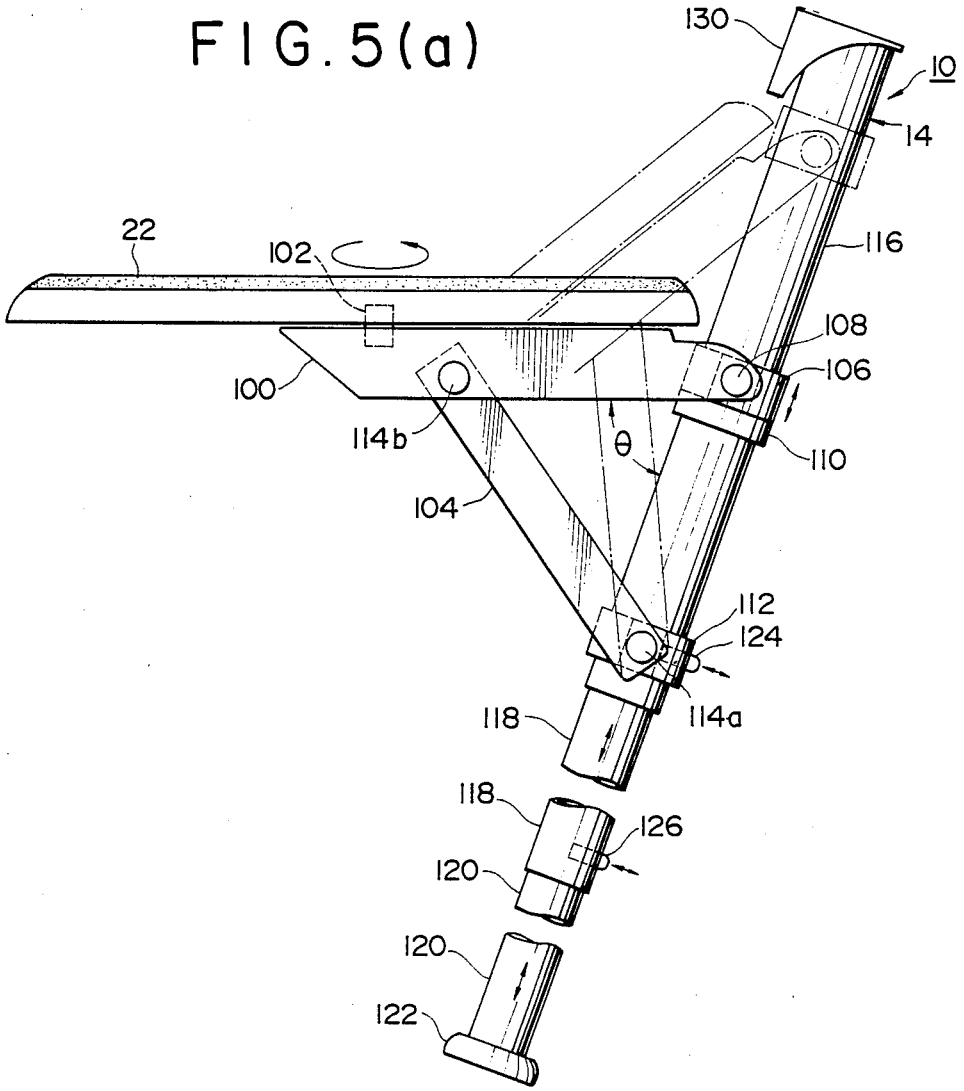
FIG. 5(*a*) is a side elevational view of a folding single-legged chair according to another embodiment of the invention, showing the chair in expanded form.
Figure 5B:
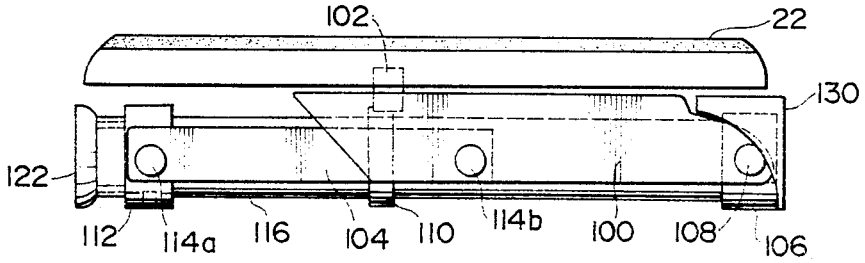

Although the saddle 22 cannot be folded in the embodiment of FIG. 1, it may be a folding type as shown in FIGS. 5(*a*) and 5(*b*). The saddle 22 is pivotally mounted on a saddle arm 100 by a pivot 102 and can be turned about the pivot 102 in a horizontal plane. The saddle arm 100 is pivotally connected at one end to an upper sleeve 106 by a pin 108, the sleeve 106 being slidably mounted on the support post 10. The downward movement of the upper sleeve 106 is restricted by a stop ring 110 fixed to the support post 10 at a predetermined position. The saddle arm 100 is pivotally connected by a pin 114*b*, at a predetermined position remote from the upper sleeve 106, to one end of a link 104, the other end of which is pivotally connected by a pin 114*a* to a lower sleeve 112 fixed to the support post 10. The angle $\theta$ of the seat 20 (in expanded posture) with respect to the support post 10 can be adjusted by varying the distance between the upper and lower sleeves 106, 112. Designated by 130 is a knob which is to be gripped in forward or sideward sitting and which also serves as a back rest in backward sitting.

The support post 10 is composed of upper, intermediate and lower tubular post members 116, 118, 120 different in diameter and telescopically connected one to another. A first spring-biased pin 124 is carried by the upper tubular member 116 near its lower end; if the first pin 124 is depressed, the intermediate tubular member 118 is allowed to be retracted into and drawn from the upper tubular member 116. Likewise, a second spring-biased pin 126 is carried by the intermediate tubular member 118 at its lower end; if the second pin 126 is depressed, the lower tubular member 120 is allowed to be retracted into and drawn from the intermediate tubular member 118.

With this arrangement, as the lower tubular member 120 is fully retracted into the intermediate tubular member 118 all the way and the intermediate tubular member 118 is in turn fully retracted into the upper tubular member 116 all the way and, additionally, as the upper sleeve 106 is moved upwardly along the upper tubular member 116 away from the stop ring 110 until the saddle 22 lies in parallel relation to the support rod 10, the chair is collapsed into a compact size convenient to carry and store, as shown in FIG. 5(*b*). FIG. 5(*a*) shows the chair in a typical in-use state with the tubular members 116, 118, 120 and telescopically extended to a desired position, and FIG. 5(*b*) shows the collapsed state of the chair wherein the tubular members are fully telescopically retracted one within the other.

Figure 6A:
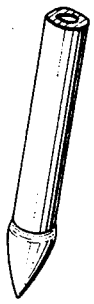
FIGS. 6(*a*) and 6(*b*) are detail views showing typical forms of the lower end portion of a support post of the chair.
Figure 6B:
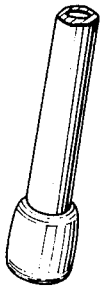

Designated by 122 in FIGS. 5(*a*) and 5(*b*) is an anti-skid cap mounted on the distal end of the lower tubular member 120 and having a flat bottom. Alternatively, the anti-skid cap may be sharp-pointed or round as shown in FIGS. 6(*a*) and 6(*b*). Preferably, the sharp-pointed cap is made of a rigid material such as metal or hard synthetic resin so that the chair is convenient for outdoor use. On the other hand, the round cap is made of preferably a soft material such as rubber for indoor use.

Figure 7A:
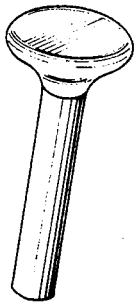
FIGS. 7(*a*), 7(*b*) and 7(*c*) are detail views showing various forms of a grip at the upper end of the support post.
Figure 7B:
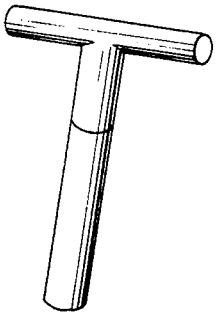
Figure 7C:
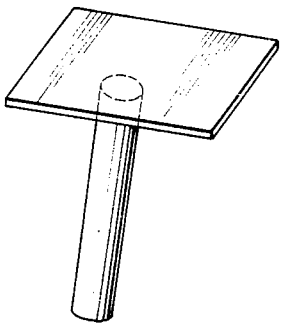

It is preferable to provide a round knob or a transverse handle on the upper end of the grip portion 14 of the support post 10, as shown in FIGS. 7(*a*) and 7(*b*), so that the seated person can rest his hands on it.

In an alternative form, a small table may be mounted on the upper end of the support post 10 for supporting a cup, a glass, a paper, etc, as shown in FIG. 7(*c*). This example is particularly convenient when the seated person has a drink or takes a note.

The principle of a single-legged chair is very similar to that of a tripod; the entire weight of the seated person is borne by three legs, i.e. the support post of the chair and two legs of the seated person.

Figure 8A:
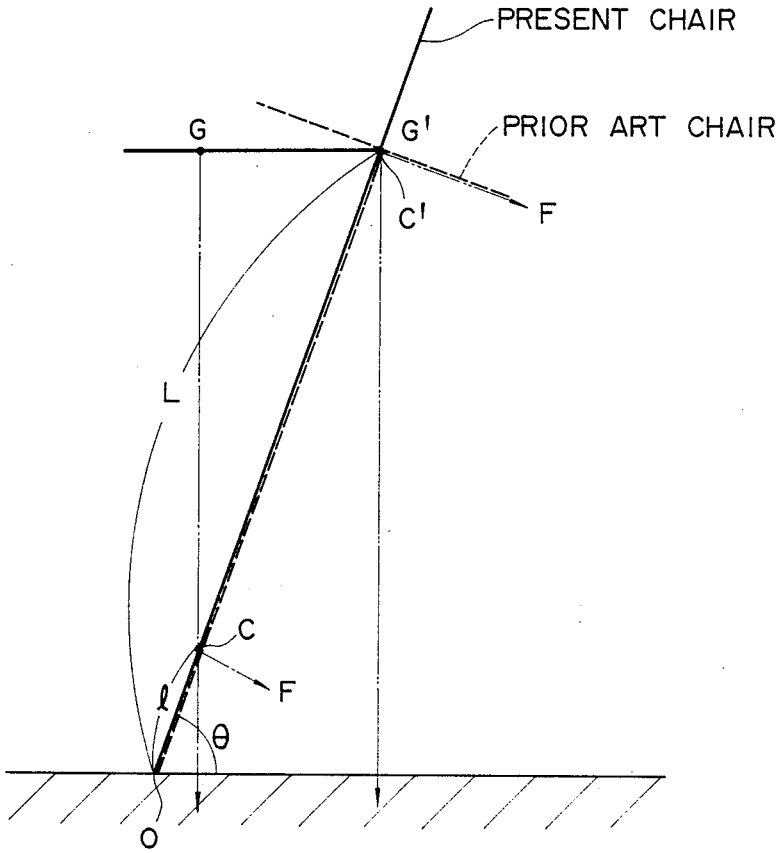
FIG. 8(*a*) is a schematic view illustrating the dynamic principles of the chair of the invention in comparison with the prior art chair.
Figure 8B:
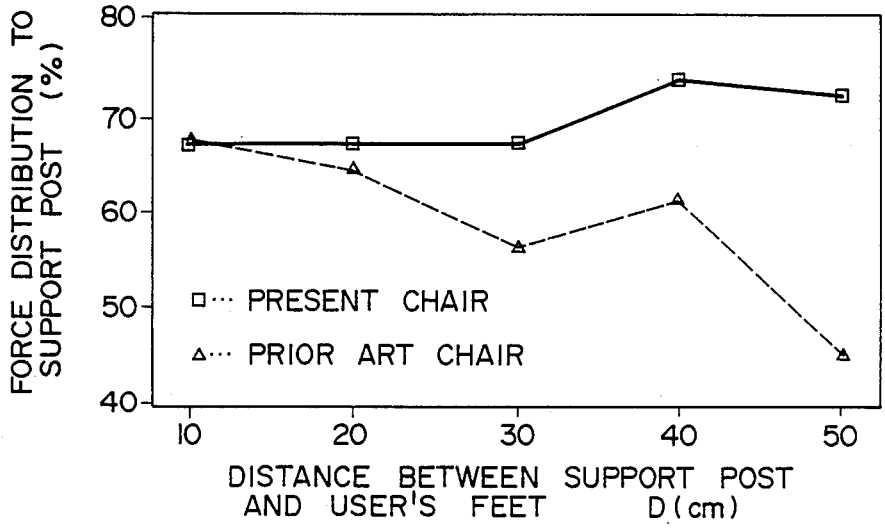
Figure 8C:
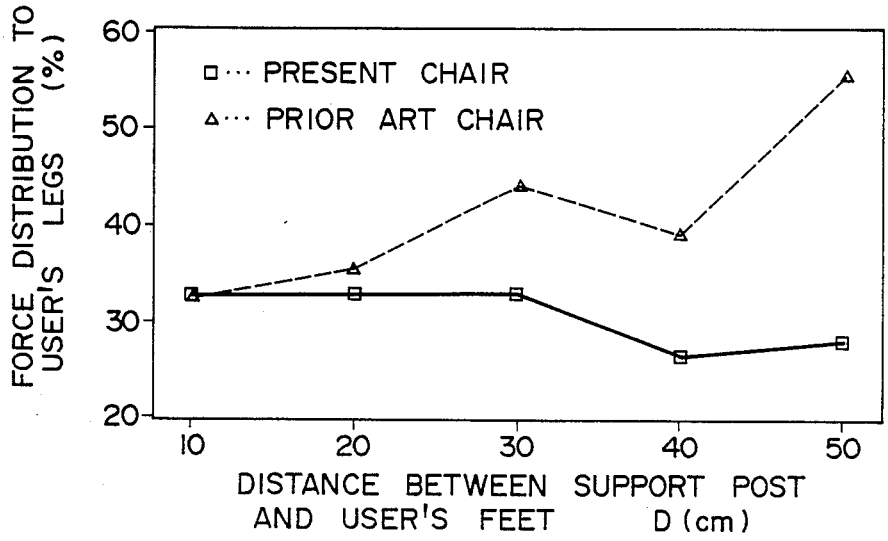
Figure 9A:
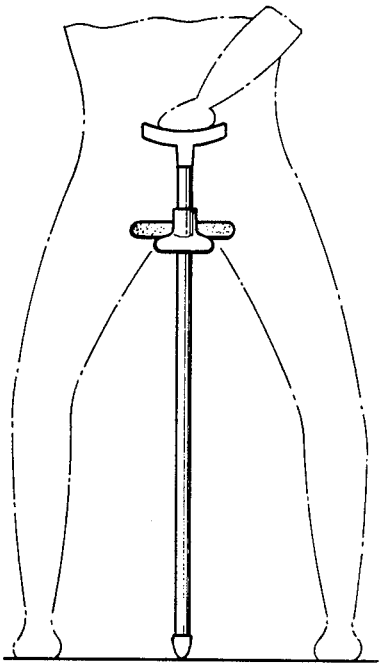
FIGS. 9(*a*), 9(*b*), 9(*c*), 9(*d*), 9(*e*) and 9(*f*) illustrate a variety of uses of the present chair.
Figure 9B:
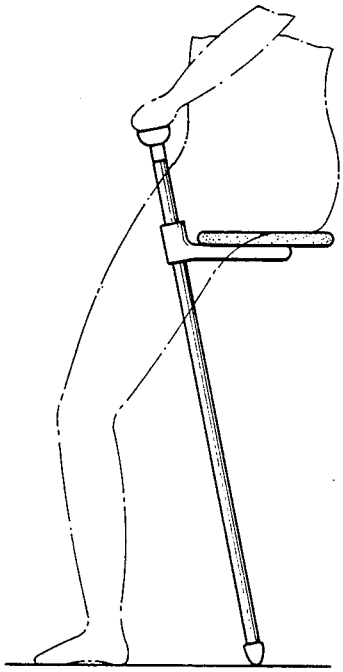
Figure 9C:
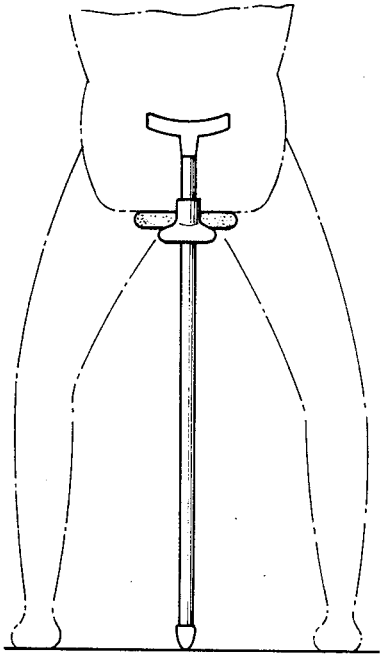
Figure 9D:
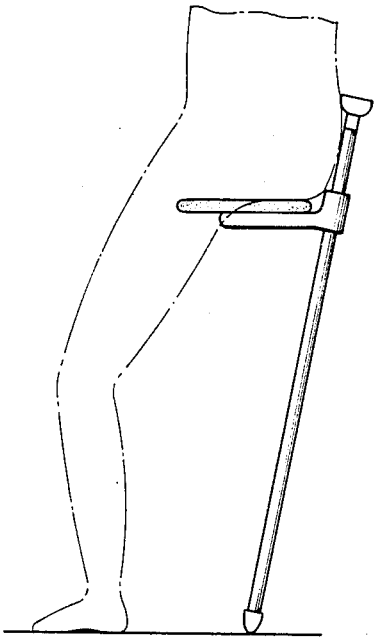
Figure 9E:
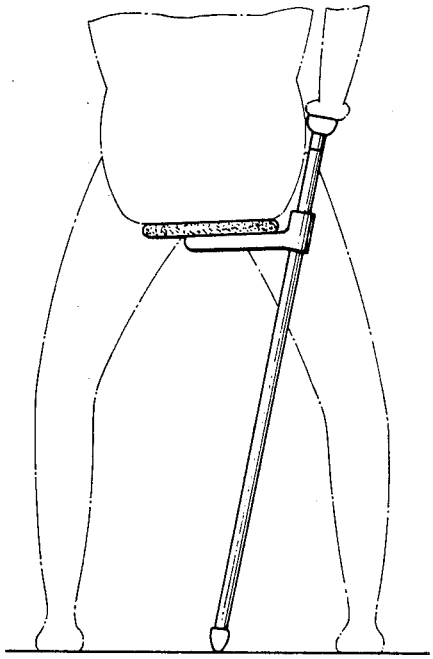
Figure 9F:
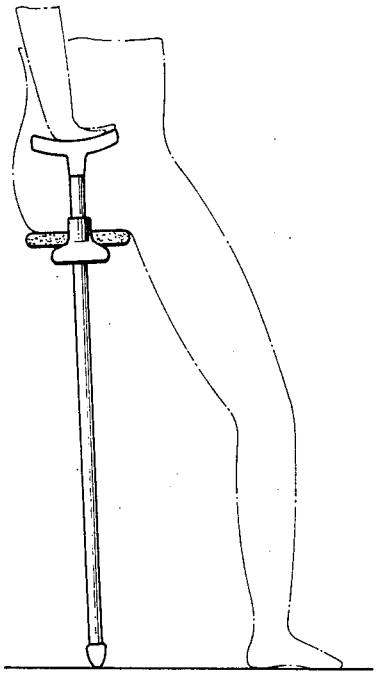
Figure 10A:
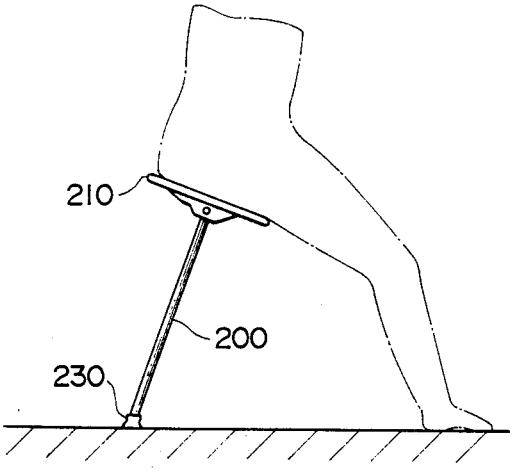
FIG. 10(a) PRIOR ART
FIG. 10(*a*) is a schematic view of a prior art chair, showing the chair in use.
Figure 10D:
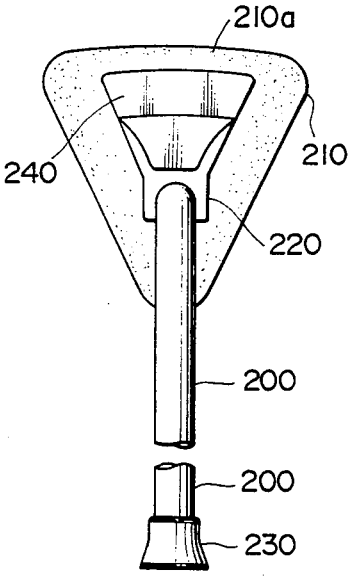
FIG. 10(d) PRIOR ART
Figure 10C:
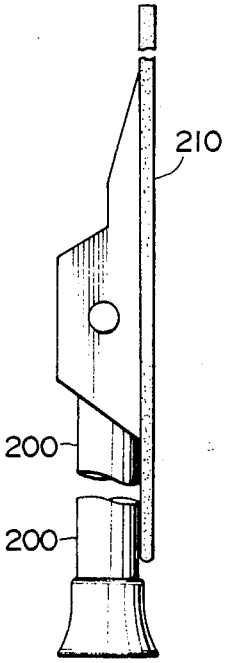
FIG. 10(c) PRIOR ART
Figure 10B:
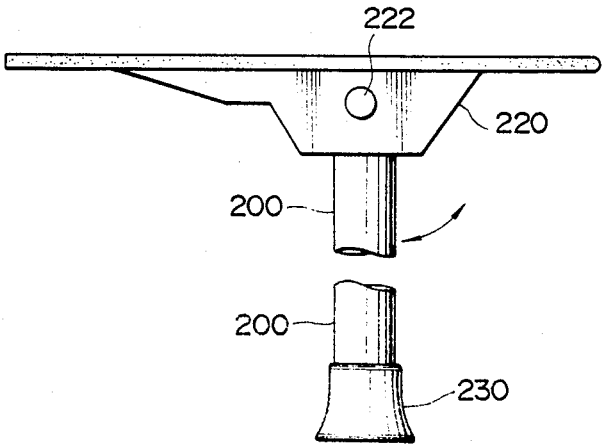
FIG. 10(b) PRIOR ART

This principle will now be discussed more in detail with reference to FIG. 8(*a*). Assuming that, with the seat lying substantially horizontally, the user sits on the seat, the majority of the entire weight of the seated person is borne by the support post, thus reducing the partial weight to be borne by the seated person's legs.

In the chair of the present invention (indicated by solid lines), the centroidal point G of the seated person is disposed at a midportion of the seat, and a crossing point C where the line of centroid (dash-and-dot line) meets the support post is the point of application to which the moment of angular movement of the support post about the point of contact O (where the lower end of the support post rests on the ground and floor surface) is to be exerted. Assuming that the user whose weight is W sits on the seat with the support post standing on the ground at an angle $\theta$, a force F acting on the support post perpendicularly thereof can be determined by the equation $F = W\cos\theta$. Therefore the moment M of angular movement of the present chair about the point of contact O can be expressed by the equation $M = F \times l$, where l is the distance between the point of contact O and the point of application C.

In the conventional chair (indicated in broken lines), the centroidal point G' of the seated person is disposed at the meeting point C' of the seat and the support post, and this meeting point C' is the point of application to which the moment of angular movement of the support post is to be exerted. Moment M' of the conventional chair can be determined by the equation $M' = F \times L$, where L is the distance between the point of contact O and the centroidal point G'. As is apparent from FIG. 8(*a*), $L > l$, therefore $M' > M$.

While the user is sitting on a single-legged chair, it is imposible that the support post stands still with no pivotal movement; that is, the support post stands on the ground at an angle $\theta \pm \alpha$. This means that the seated person keeps doing work in terms of dynamics to support the chair tending to fall. The work done by the seated person is proportional to the moment of angular movement of the chair. Therefore the amount of work by the seated person per hour with the present chair is remarkably small, compared with that with the conventional chair. As a result, the user's fatigue from sitting on the present chair is smaller than the fatigue from sitting on the conventional chair.

The balance of the chair when the user sits thereon can be evaluated in terms of coefficient of variation of the work done by the seated person. With the present chair, it is possible to reduce the absolute value of the work to be done by the seated person.

A primary advantage of the present chair is that since the majority of the weight of the seated person is borne by the support post, a load to be exerted on his legs is very small. Further, it is possible to reduce the moment of angular movement of the chair by moving the point of application C toward the point of contact O to minimize the distance l.

Comparative experiments were conducted under the direction by the inventors. The results of the experiments are shown in FIGS. 8(*b*) and 8(*c*), from which it turns out that with the present chair, the ratio between the force exerted on the support post and the force exerted on the seated person's legs varies only slightly even when the distance D between the lower end of the support post and the seated person's feet is increased. Irrespective of the distance D, the support post bears approximately 70% of the entire weight of the seated person, and the seated person's legs in turn bears only a small amount of load.

On the contrary, with the conventional chair, the larger the distance the seated person's feet are spaced from the support post, the more the seated person's legs bear the load. If the seated person's feet are spaced only a small distance from the support post with the latter kept virtually vertically, the force to be exerted on the seated person's legs can be reduced; however, this posture is non-stable, and hence it is highly likely that the seated person is thrown off balance.

According to the present chair, partly because the majority of the entire weight of the seated person is borne by the support post of the chair and partly because the seat is kept substantially in a horizontal posture, adequately stable and agreeable sitting can be achieved.

Another advantage of the present chair is that since there is a grip portion of the support post above the seat, the seated person can hold the grip portion to assist not only in changing his sitting posture but also in shifting the chair. Further, since the user can keep his sitting posture with adequate stableness without resting his hands on the grip portion, the present chair is particularly useful when used in playing chess or shogi (Japanese chess) outdoors or in working while standing.

Moreover, since the user can sit on the present chair for a long time, even hours, comfortably without getting so tired, the present chair is suitable for use in sports spectating, bird-watching, fishing, etc.

Although various minor modifications may be suggested by those versed in the art, it should be understood that we wish to embody within the scope of the patent granted hereon, as resonably and properly come within the scope of our contribution to the art.

What is claimed is:

1. A foldable single-legged chair comprising:

(a) a support post composed of upper, intermediate and lower tubular members different in diameter and telescopically connected one to another, said upper tubular member carrying on its lower end portion a first spring-biased pin normally projecting radially into said intermediate tubular member to prevent said intermediate tubular member from being retracted into and drawn from said upper tubular member, said first spring-biased pin being depressable to allow said intermediate tubular member to be retracted into and drawn from said upper tubular member, said intermediate tubular member carrying on its lower end portion a second spring-biased pin normally projecting radially into said lower tubular member to prevent said lower tubular member from being retracted into and drawn from said intermediate tubular member, said second spring-biased pin being depressable to allow said lower tubular member to be retracted into and drawn from said intermediate tubular member; and (b) a seat including a lower sleeve fixedly mounted on said upper tubular member, an upper sleeve slidably mounted on said upper tubular member and movable toward and away from said upper sleeve, a saddle arm pivotally connected at one end to said upper sleeve, a stop ring mounted on said upper tubular member at a predetermined position between said upper and lower sleeves for retracting downward movement of said upper sleeve, a link pivotally connected at one end thereof to said saddle arm at a predetermined position remote from said upper sleeve and pivotally connected at the other end thereof to said lower sleeve, and a saddle pivotally mounted on said saddle arm, said upper sleeve being movable between an upper position in which said upper sleeve is disposed away from said stop ring in such a manner that said saddle lies in closely spaced parallel relation to said upper tubular member and a lower position in which said upper sleeve is disposed against said stop ring in such a manner that said saddle lies at a predetermined angle of 70° to 85° with respect to said support post.

2. A foldable single-legged chair according to claim 1; wherein said stop ring is adjustably mounted on said upper tubular member so that said angle of said saddle with respect to said support post can be adjusted.

3. A collapsible single-legged chair comprising: a support post comprised of upper, intermediate and lower post members telescopically connected to one another to enable extension and retraction of the support post between a fully retracted position and a desired extended position; locking means for releasably locking the post members in a desired telescopically extended position; a seat; and means displaceably mounting the seat on the support post for displacement between an unfolded position wherein the seat lies at a predetermined angle within the range of 70° and 85° with respect to the extended support post to define the in-use state of the chair and a folded position wherein the seat lies adjacent and parallel to the fully retracted support post to define the collapsed state of the chair, the means displaceably mounting the seat including means adjustably mounting the seat on the support post to enable adjustment of the angle of the seat relative to the support post within the range of 70° and 85°.

4. A collapsible single-legged chair according to claim 3; wherein the lengths of the upper, intermediate and lower post members are selected relative to the length of the seat so that when the post members are fully telescopically retracted one within another, the overall length of the fully retracted support post approximates the length of the seat.

5. A collapsible single-legged chair according to claim 3; wherein the locking means comprises sets of longitudinally spaced openings in the post members positioned so the openings in one post member align with openings in an adjacent post member during extension and retraction of the post members, and means insertable into aligned openings in two adjacent post members to releasably lock the same together in a desired telescopically extended position.

* * * * *